US007055436B2

(12) United States Patent
Glatthaar et al.

(10) Patent No.: US 7,055,436 B2
(45) Date of Patent: Jun. 6, 2006

(54) SHELL FUSE

(75) Inventors: Karl Glatthaar, Oberndorf (DE); Gerd Giesler, Mönchweiler (DE); Horst Moosmann, Schramberg (DE); Wolfgang Schillinger, Schiltach (DE); Frank Kienzler, Villingen (DE)

(73) Assignee: Junghans Feinwerktechnik GmbH & Co. KG, Schramberg (DE)

( * ) Notice: Subject to any disclaimer, the term of this patent is extended or adjusted under 35 U.S.C. 154(b) by 42 days.

(21) Appl. No.: 10/727,800

(22) Filed: Dec. 4, 2003

(65) Prior Publication Data

US 2004/0144279 A1 Jul. 29, 2004

(30) Foreign Application Priority Data

Jan. 25, 2003 (DE) ..... 103 02 967

(51) Int. Cl.
*F42C 15/00* (2006.01)

(52) U.S. Cl. ..... 102/221; 102/222; 102/226; 102/229; 102/251

(58) Field of Classification Search ..... 102/221, 102/251, 222, 226, 229
See application file for complete search history.

(56) References Cited

U.S. PATENT DOCUMENTS

| | | | | | |
|---|---|---|---|---|---|
| 2,853,011 | A | * | 9/1958 | Will et al. | 102/226 |
| 3,000,315 | A | * | 9/1961 | Anastasia et al. | 102/251 |
| 3,468,256 | A | * | 9/1969 | Vanover | 102/275 |
| 3,768,415 | A | * | 10/1973 | Czajkowski et al. | 102/225 |
| 3,779,169 | A | * | 12/1973 | Backstein et al. | 102/229 |
| 4,393,780 | A | | 7/1983 | Zacharin | |
| 4,550,661 | A | * | 11/1985 | Rehmann | 102/251 |
| 4,854,239 | A | | 8/1989 | Van Sloun | |
| 5,275,107 | A | * | 1/1994 | Weber et al. | 102/251 |
| 5,693,906 | A | | 12/1997 | Van Sloun | |

FOREIGN PATENT DOCUMENTS

DE 696 11 922 T2 7/1998

* cited by examiner

*Primary Examiner*—M. Clement
(74) *Attorney, Agent, or Firm*—Laurence A. Greenberg; Werner H. Stemer; Ralph E. Locher

(57) ABSTRACT

A shell fuse has a target acquisition sensor, such as an impact sensor, and a firing train in which a firing device carrier is movable from a safe position into an armed position. Overflight safety all the way to the target is afforded in a simple manner. There is provided a force element, in particular a pyrotechnic trigger device, which can be initiated by the response of the sensor. The force element is coupled to the firing device carrier such that the firing device carrier is movable into the armed position.

10 Claims, 2 Drawing Sheets

SHELL FUSE

BACKGROUND OF THE INVENTION

Field of the Invention

The invention concerns a shell fuse having a target acquisition sensor, in particular an impact sensor, and a firing train in which a firing device carrier is movable from a safe position into an armed position.

In prior art fuses for shells, in the safe position a primary firing means arranged in a firing device carrier, for example a rotor, is pivoted out of the firing train. It is only after launch of the shell and more specifically with a bore-safety factor that the primary firing means is pivoted into the firing train. The corresponding time is very short in comparison with the total flight time of the shell. The fuse is therefore in the armed position throughout almost the entire shell flight time. The firing train does not afford an overflight safety aspect.

Usually an overflight safety aspect is achieved in that an electronic system of the fuse, in dependence on its programming, charges up an electrical firing circuit only at a certain moment in time shortly before the projectile reaches the target and thus renders the fuse ready for operation.

SUMMARY OF THE INVENTION

It is accordingly an object of the invention to provide a fuse configuration, which overcomes the above-mentioned disadvantages of the heretofore-known devices and methods of this general type and which provides for overflight safety as far to the target in a simple manner.

With the foregoing and other objects in view there is provided, in accordance with the invention, a shell fuse configuration, that is a fuse for a projectile. The novel device comprises:

a target acquisition sensor, such as, for example, an impact sensor;

a firing train including a firing device carrier movably disposed from a safe position into an armed position;

a force element disposed to be initiated by the target acquisition sensor and coupled to the firing device carrier for moving the firing device carrier into the armed position.

In accordance with an added feature of the invention, the force element is coupled to a firing pin of the firing train such that the firing pin is blocked in the safe position and released in the armed position.

In accordance with an additional feature of the invention, a linearly movable pin is provided for coupling the force element to the firing device carrier. In a preferred embodiment, there is provided a safety pin coupling the force element to the firing pin, with the safety pin bearing against the linearly movable pin.

In accordance with another feature of the invention, an electronic system is connected to the sensor and the force element. Upon target acquisition, the sensor passes a signal to the electronic system, and the electronic system triggers the force element.

In accordance with a further feature of the invention, the force element is a pyrotechnic force element with a piston bearing against the linearly movable pin coupling the force element the firing device carrier.

In accordance with a preferred feature of the invention, the linearly movable pin is displaceably supported parallel to the firing pin and the safety pin is transversely displaceable with respect to the linearly movable pin.

In accordance with again an added feature of the invention, the linearly movable pin is formed with a recess for receiving the safety pin in the armed position.

In accordance with again another feature of the invention, the firing pin is formed with a bevel whereupon the safety pin is braced against in the safe position.

In accordance with a concomitant feature of the invention, the firing device carrier is a rotor formed with a radial nose, and the linearly movable pin is disposed to act upon the rotor via the nose.

In other words, the objects of the invention are achieved in that there is provided a force element which can be initiated by the response of the sensor and which is coupled to the firing device carrier in such a way that the firing device carrier is movable into the armed position. As a result, it is ensured that the firing train is only closed when the target has practically been reached. Therefore the bore safety factor is integrated with an overflight safety factor as far as the target. There is no need for specifically separate devices for ensuring bore safety and overflight safety respectively. The sensor initiates the armed position and firing substantially simultaneously, by way of the force element.

The force element is preferably coupled to a firing pin or striker of the firing train in such a way that the firing pin is blocked in the safe position and released in the armed position. This provides that the firing pin can become operative only when the firing device carrier is in the armed position.

Other features which are considered as characteristic for the invention are set forth in the appended claims. Although the invention is illustrated and described herein as embodied in a shell fuse, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
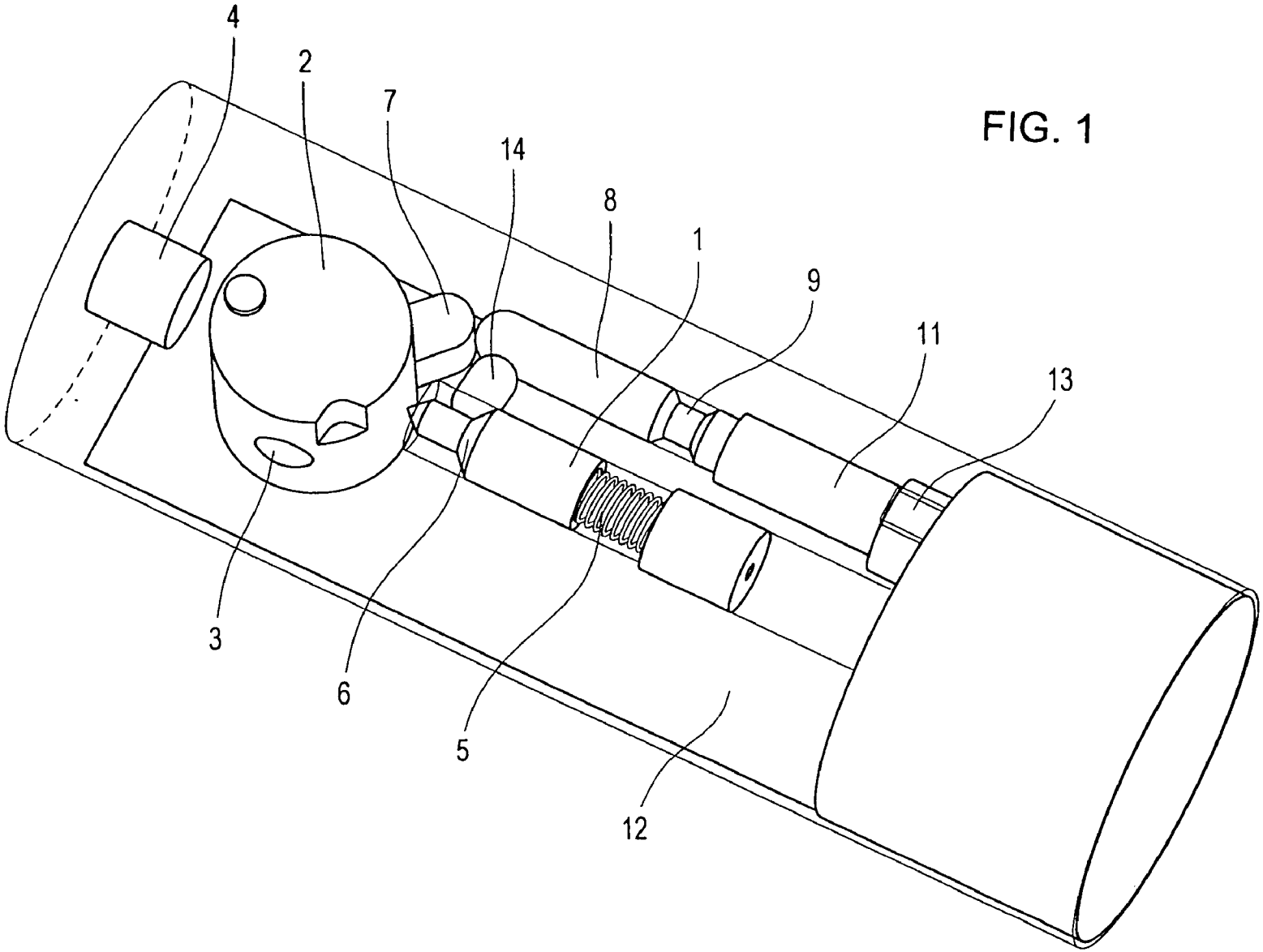
FIG. 1 is a partly broken away, perspective view showing a mechanical firing system of a shell fuse in the safe position.

Referring now to the figures of the drawing in detail a fuse of a shell has in a firing train with a firing pin or striker 1, a rotor 2 forming a firing device carrier that carries a primary firing means in the form of a piercing detonator 3, and a secondary firing means 4. The firing pin 1 is subjected to the force of a compression spring 5 and has a bevel 6.

The rotor 2 is provided with a radial nose 7 with which there is associated a linear pin 8, which is movable parallel to the firing pin 1. The pin 8 is formed with a recess 9 and is connected to a piston 10 of a pyrotechnic force element 11. The pin 8 and the piston 10 can be formed in one piece.

A target acquisition sensor 13 is connected to an electronic system 12 with which the force element can be initiated. The sensor 13 can be an impact sensor, a proximity sensor, or a spacing sensor.

A safety pin 14 is displaceable between the firing pin 1 and the pin 8, transversely with respect to the direction of movement thereof.

In the safe position illustrated in FIG. 1, the rotor 2 is pivoted in such a way that the piercing detonator 3 is outside the firing train. The firing pin 1 is blocked by virtue of the fact that the safety pin 14 which is supported by the pin 8 bears against the bevel 6 of the firing pin 1. That safe position is maintained during the flight of the shell as far as the target.

Figure 2:
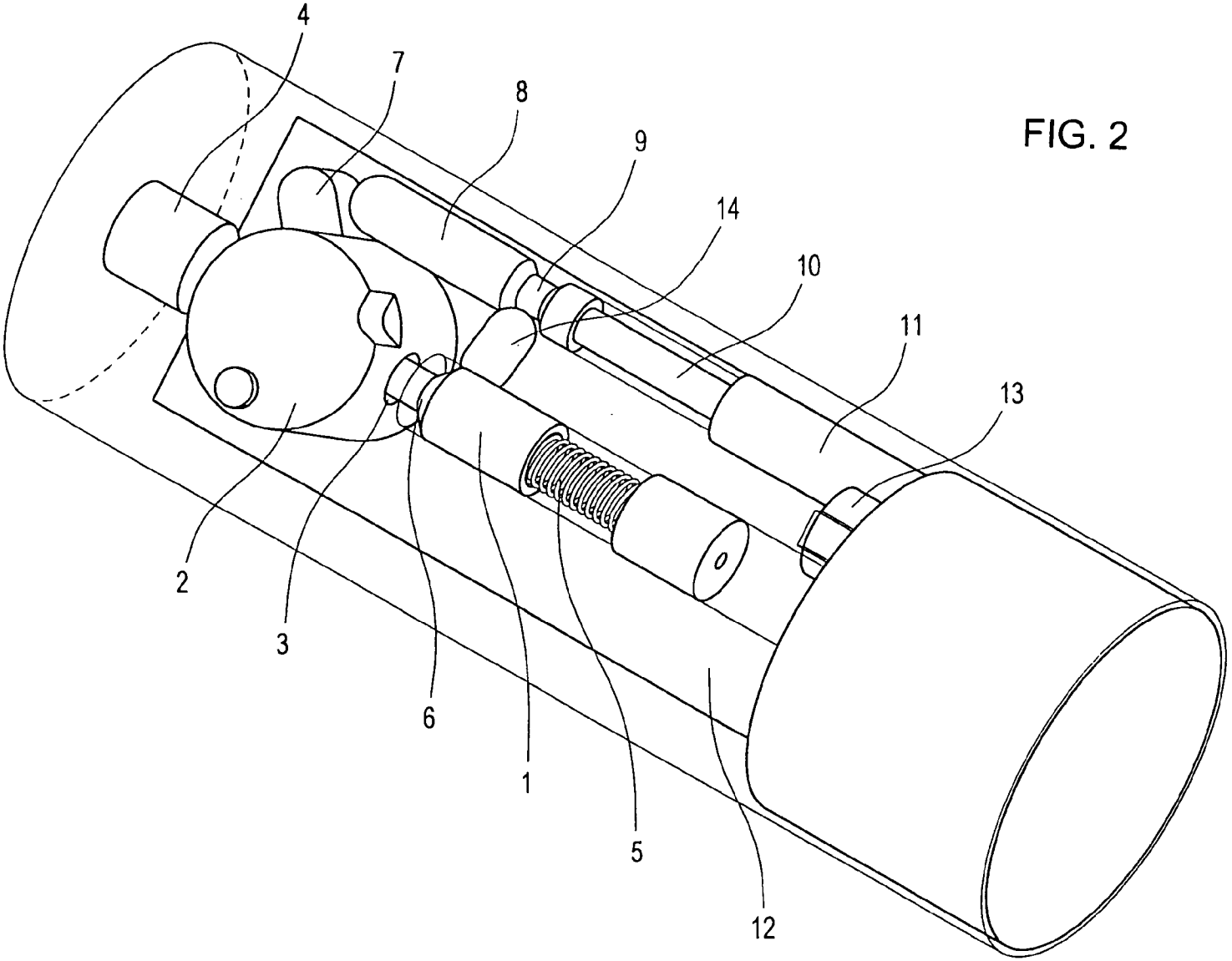
FIG. 2 is a similar view showing the firing system in the armed position.

Upon target acquisition, in particular target impact in the case of an impact sensor, the sensor 13 responds. As a result the force element 11 is fired by way of the electronic system 12, whereby its piston 10 displaces the pin 8. The pin 8 strikes against the nose 7 which causes the rotor 2 to pivot into the armed position illustrated in FIG. 2. The electronic system 12 has still further functions to perform; for example it can produce a time delay such that firing only takes place when the shell has penetrated into the target.

When the pin 8 has pivoted the rotor 2 its recess 9 is at the safety pin 14 (see FIG. 2) so that the latter is displaced by the compression spring 5 by means of the bevel 6 and releases the firing pin 1. The latter now strikes under the force of the compression spring 5 against the piercing detonator 3 whereby firing is effected or initiated.

We claim:

1. A shell fuse, comprising:

a target acquisition sensor;

a firing train including a firing device carrier movably disposed from a safe position into an armed position, and a linearly movable firing pin;

a force element disposed to be initiated by said target acquisition sensor and a linearly movable pin coupling said force element to said firing device carrier for moving said firing device carrier into the armed position, said linearly movable pin being displaceably supported parallel to said firing pin.

2. The shell fuse according to claim 1, wherein said target acquisition sensor is an impact sensor.

3. The shell fuse according to claim 1, wherein said force element is coupled to a firing pin of said firing train via said linearly movable pin such that said firing pin is blocked in the safe position and released in the armed position.

4. The shell fuse according to claim 1, which comprises a safety pin coupling said force element to said firing pin, said safety pin bearing against said linearly movable pin.

5. The shell fuse according to claim 1, which comprises an electronic system connected to said sensor and said force element, wherein, upon target acquisition, said sensor passes a signal to said electronic system, and said electronic system initiates said force element.

6. The shell fuse according to claim 1, wherein said force element is a pyrotechnic force element with a piston bearing against said linearly movable pin coupling said force element said firing device carrier.

7. The shell fuse according to claim 1, wherein said safety pin is transversely displaceable with respect to said linearly movable pin and said firing pin.

8. The shell fuse according to claim 4, wherein said linearly movable pin is formed with a recess for receiving said safety pin in the armed position.

9. The shell fuse according to claim 1, wherein said firing pin is formed with a bevel and said bevel is braced against said safety pin in the safe position.

10. The shell fuse according to claim 1, wherein said firing device carrier is a rotor formed with a radial nose, and said linearly movable pin is disposed to act upon said rotor via said nose.

* * * * *